US005417282A

United States Patent [19]

Nix

[11] Patent Number: 5,417,282

[45] Date of Patent: May 23, 1995

[54] USE OF LIGHTNING FOR EXTRACTION OF HYDROCARBON FUELS

[76] Inventor: Martin E. Nix, P.O. Box 95173, Seattle, Wash. 98145-2173

[21] Appl. No.: 200,203

[22] Filed: Feb. 23, 1994

[51] Int. Cl.[6] ..... E21B 43/24

[52] U.S. Cl. ..... 166/248; 166/65.1; 166/302

[58] Field of Search ..... 166/248, 263, 302, 52, 166/57, 65.1; 60/641.1

[56] References Cited

U.S. PATENT DOCUMENTS

| | | | |
|---|---|---|---|
| 196,235 | 10/1877 | Knapp | 403/275 X |
| 3,547,193 | 12/1970 | Gill | 166/248 |
| 4,084,638 | 4/1978 | Whiting | 166/248 |
| 4,250,230 | 2/1981 | Terry | 166/65.1 X |
| 4,572,582 | 2/1986 | Ryeczek | 166/248 X |

*Primary Examiner*—George A. Suchfield

[57] ABSTRACT

Described is a method of insitu conversion of coal formations to oil, natural gas, and alcohol fuels, and a method of tertiary oil recovery using lightning as an energy source. Lightning rods which are insulated from other geologic strata conduct lightning to an embedded metal block, the embedded block located in the coal or oil bearing geologic strata. The metal block attracts lightning via the lightning rod, but also serves as capacitance. The conductance of electricity from one lightning rod (+) to another lightning rod (−) through the hydrocarbon bearing strata converts the coal and water to oil, natural gas, and alcohols or secondarily extracts oil as tertiary recovery. The oil, natural gas and alcohols are extracted via traditional pumping methods.

2 Claims, 1 Drawing Sheet

USE OF LIGHTNING FOR EXTRACTION OF HYDROCARBON FUELS

BACKGROUND OF THE INVENTION

1. Field of the Invention

A method of tertiary oil recovery, and a method in-situ coal conversion to oil, natural gas and alcohols is discussed.

2. Prior Art

The extraction of energy from coal and oil fields has been a very difficult and costly art with a long history of environmental destruction. Unfortunately, extraction of energy from the earth inexpensively and cleanly has been difficult. What is needed is a lower cost and cleaner method. U.S. Pat. No. 4,250,230 (Terry, Feb. 10, 1981) illustrates a method of insitu coal gasification. U.S. Pat. No. 5,211,223 (Mulville, May 18, 1993) illustrates the principle of a downhole heater to extract more oil. U.S. Pat. No. 5,217,076 (Masek, Jun. 8, 1993) illustrates methods of oil recovery. In no case, is the energy of lightning utilized for energy recovery from oil or coal bearing geologic formations illustrated in prior art. It is a well known fact that lightning contains millions of volts and amps and can be very destructive, yet few if any applications in prior art have tapped this powerful energy resource for benefit to mankind.

SUMMARY OF INVENTION

Except for lightning rods utilized for prevention of destruction, there is very little use of lightning for useful work. Nevertheless, lightning can be used to convert underground coal insitu to liquid fossil fuel as oil and alcohols and to natural gas. Heat and electricity from lightning can force the disassociation of coal into carbon, and also water into hydrogen and oxygen. The recombination of such results into oil, natural gas and alcohols. Secondarily, lightning can be used to heat oil bearing geologic strata resulting in tertiary oil recovery. To aid in use of electricity from lightning, a plurality of lightning rods inserted into well casings is designed, means to direct skyward lightning into a coal or oil bearing geologic strata. Embedded into the hydrocarbon bearing formation and attached to the bottom of each lightning rod is a metal block, means to attract lightning but also to serve as capacitance. The lightning rods are insulated from other non-hydrocarbon strata or other water aquifiers via insulation such as glass or silica. It is common knowledge in a lightning storm, lightning will travel from one location (+) to another (−), travel from the sky (+) to the ground (−) and vise versa, or through the ground. Thus, lightning can be directed by a field of lightning rods to produce a current in a coal formation, or secondarily for tertiary oil recovery.

It is an object to attract lightning from the sky to a coal formation via lightning rods.

It is an object to insulate the lightning rods from other non-hydrocarbon strata and other aquifiers.

It is an object to conduct lightning through coal and water formations, means to convert coal to oil, natural gas and alcohols.

It is another object to prevent destruction of the environment by eliminating the need for strip mining.

It is an object to use injection wells to inject an electrically conductive fluid as water into a coal formation or oil formation.

It is an objective to use extraction wells for removal of oil, natural gas and alcohols.

It is an object to embed a large metal block in a coal or oil formation, means to attract lightning from the sky and to provide capacitance.

It is an object to create a plurality of lightning rods over a land area, means to provide conductance through a coal or oil formation.

It is an object to develop the use of lightning for tertiary oil recovery.

It is an object to capture the energy of lightning for useful work.

It is an object to use the heat and electricity of lightning to disassociate coal into carbon and water into hydrogen and oxygen, the recombination of which results in oil, natural gas and alcohols.

DESCRIPTION OF PREFERRED EMBODIMENTS

Figure 1:
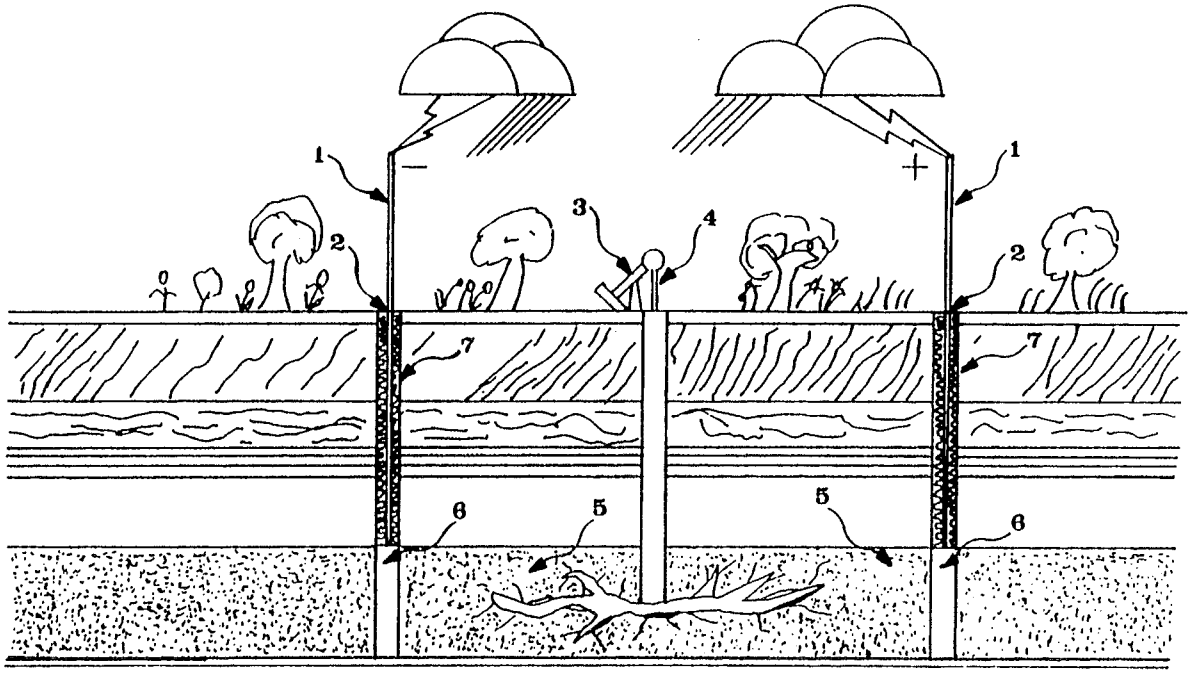
FIG. 1 is a cross sectional view of the functional components.

Lightning for years has fascinated mankind but it's constructive use for work has been a difficult challenge. It is a well known fact lightning contains millions of amps and volts for short period of time. Lightning can go from the sky (+), to the ground (−) or through the earth.

Lightning rods (1) are a known science and art to attract lightning. By placing a lightning rod (1) into a well casing (2) lightning can be tracked to a metal block (6). The metal block (6) serves the useful function of attracting lightning from the sky, but also as capacitance until the electrons are distributed into the earth (5). The lightning rod (1) is insulated from other geologic formations by insulation (7) such as glass or silica. The metal block (6) is embedded in a hydrocarbon formation (5). As the metal block (6) is electrically charged, electricity flows through the hydrocarbon geologic strata (5) to another block. The chemical reaction, heat and pressure combined with electricity produced from lightning disassociates the hydrocarbon strata (5) into carbon, and in conjunction water into hydrogen and oxygen, the recombination results in oil, natural gas and alcohols for extraction. Secondarily, the heat and pressure created by the electricity flow of lightning, boils underground water into steam. The lightning rods (1) and related assemblies (2) (7)(6) can be dispersed throughout a land area into a network. Thus, hydrocarbon extraction for liquid and gaseous fuels can be accomplished without costly strip mining or environmental destruction. So as to assist lightning flow through a hydrocarbon formation (5) injection wells (3) may be used to inject an electrically conducting fluid as water into the hydrocarbon bearing formation (5). The injection wells (3), later may be converted into extraction wells (4). The entire system (1) (2) (3) (4) (5) (6) (7) would have application for converting underground coal (5) into oil, natural gas or alcohols. Also, the entire system (1) (2) (3) (4) (5) (6) (7) would have application for tertiary oil recovery from an oil bearing strata (5).

I claim:

1. A method for converting underground coal to oil, natural gas and alcohols, comprising the steps of:

(a) positioning a lightning rod in a well casing comprising means to attract lightning from the sky;

(b) positioning a metal block at the base of said lightning rod and said well casing, said metal block embedded in said coal formation comprising means to attract lightning from the lightning rod;

(c) positioning of a plurality of well casings so completed with lightning rods and metal blocks, as set forth in steps (a) and (b), over a land area in an evenly spaced arrangement comprising means to conduct electricity from lightning through the coal formation;

wherein electricity from lightning disassociates the molecules of coal and water into the elements of carbon, hydrogen, and oxygen, the recombination of said elements form oil, natural gas, and alcohols, which are subsequently produced to the surface.

2. A method of tertiary oil recovery, comprising the steps of:

(a) positioning a lightning rod in a well casing comprising means to attract lightning from the sky;

(b) positioning a metal block at the base of said lightning rod and said well casing, said metal block embedded in an oil bearing geologic formation comprising means to attract lightning from the lightning rod;

(c) positioning a plurality of well casings so completed with lightning rods and metal blocks as set forth in steps (a) and (d), over a land area in an evenly spaced arrangement comprising means to conduct electricity from lightning through said oil bearing geologic formation;

wherein electricity from lightning heats and cracks the oil bearing geologic formation, resulting in enhanced flow of oil for pumping to the surface.

* * * * *